US006062893A

United States Patent [19]

Miskin et al.

[11] Patent Number: 6,062,893

[45] Date of Patent: May 16, 2000

[54] ADAPTER FRAME FOR AN ELECTRICAL CONNECTOR

[75] Inventors: Michael J. Miskin, Little Rock, Ark.; Jay H. Neer, Boca Raton, Fla.; Kenneth Stanevich, Sycamore, Ill.

[73] Assignee: Molex Incorporated, Lisle, Ill.

[21] Appl. No.: 09/090,519

[22] Filed: Jun. 4, 1998

[51] Int. Cl.[7] ..... H01R 13/64

[52] U.S. Cl. ..... 439/374; 439/607

[58] Field of Search ..... 439/374, 377, 439/297, 939, 609, 544, 607

[56] References Cited

U.S. PATENT DOCUMENTS

| | | | |
|---|---|---|---|
| 4,747,785 | 5/1988 | Roberts et al. | 439/88 |
| 5,207,586 | 5/1993 | MacGregor et al. | 439/76 |
| 5,425,646 | 6/1995 | Green | 439/79 |
| 5,454,725 | 10/1995 | Speiser et al. | 439/61 |
| 5,476,387 | 12/1995 | Ramey et al. | 439/76.1 |
| 5,628,653 | 5/1997 | Haas et al. | 439/607 |
| 5,691,881 | 11/1997 | McDonough | 361/682 |
| 5,734,558 | 3/1998 | Poplawski et al. | 361/752 |
| 5,797,770 | 8/1998 | Davis et al. | 439/607 |
| 5,864,468 | 1/1999 | Poplawski et al. | 361/753 |
| 5,913,698 | 6/1999 | Keng | 439/939 |

*Primary Examiner*—Michael L. Gellner
*Assistant Examiner*—Antoine Ngandjui
*Attorney, Agent, or Firm*—A. A. Tirva

[57] ABSTRACT

A stamped and formed metal adapter frame is provided for mounting an electrical connector in an aperture in a panel. The frame includes a receptacle portion positionable in the aperture in the panel for receiving the electrical connector. Supporting wall portions project from the receptacle portion. At least one first stiffening rib is formed in at least one of the wall portions and includes a stop for abutting the panel. At least one second stiffening rib is formed in at least one of the wall portions and defines a guide rail for the electrical connector inserted through the receptacle portion. Integral flexible gasket fingers are formed about the periphery of the receptacle portion. At least one mounting peg is insertable into a mounting hole in a printed circuit board and includes at least two levels of engaging surfaces for engaging at least two printed circuit boards of different thicknesses. A door closes the receptacle portion and is biased toward a closed position by cam ramps on the side wall portions of the frame.

26 Claims, 6 Drawing Sheets

ADAPTER FRAME FOR AN ELECTRICAL CONNECTOR

FIELD OF THE INVENTION

This invention generally relates to the art of electrical connectors and, particularly, to an adapter frame for mounting an electrical connector, such as in an aperture in a panel.

BACKGROUND OF THE INVENTION

Electrical connectors are used in a wide variety of applications ranging from simple connecting interfaces between hard conductor wiring to more sophisticated applications involving such components as printed circuit boards, flat flexible cables and optical fibers. Basically, electrical connectors include some form of contacts, terminals or other conductors which interconnect one electrical device to another electrical device. The electrical connectors may involve systems whereby the connectors provide receiver-transmitter functions which, in addition, can convert high speed signals from solid (copper) cables or fiber optic cables to high speed signals on a system printed circuit board as used herein, the terms "electrical" or "electrical connectors" are intended to include optical devices.

For instance, in the telecommunications industry, switching systems or circuitry may be provided on a rather sizable mother board at a particular location. A plurality of high speed electrical converter modules are mounted by appropriate frame structures on the mother board. Mating "plug-in" connector modules are plugged into the converter modules from outside the switching system. The incoming signals from the cables attached to the plug-in modules are at high speed, such as in the gigabit range, and the converter modules transfer and maintain the signals at high speed and transmit them to the circuitry on the mother board. Continuing problems have been encountered in the design and manufacturability of such systems, and the present invention is directed to solving those problems by providing a simple system which is cost effective to manufacture, assemble and use.

SUMMARY OF THE INVENTION

An object, therefore, of the invention is to provide a new and improved stamped and formed metal adapter frame for mounting an electrical connector module in an aperture in a panel.

In the exemplary embodiment, the adapter frame includes a receptacle portion positionable in the aperture in the panel for receiving the electrical connector module. Supporting wall portions project from the receptacle portion. At least one stiffening rib is formed in at least one of the wall portions. The stiffening rib includes a stop for abutting the panel to define a preferred position of the adapter frame relative to the panel.

The invention contemplates that a second stiffening rib is formed in at least one of the wall portions and projecting inwardly therefrom to define a guide rail for the electrical connector inserted through the receptacle portion.

Another feature of the invention is the provision of an integral, flexible gasket means about the receptacle portion for engaging the interior of the aperture in the panel and the exterior of the electrical connector. As disclosed herein, the gasket means is formed by integral inwardly and outwardly deformed flexible fingers.

According to another aspect of the invention, a door is pivotally mounted between the side wall portions of the adapter frame for pivotal movement between a closed position closing the receptacle portion and an open position when the electrical connector is inserted into the frame. Cam ramps are provided on the side wall portions engageable by cam follower projections on the door to automatically bias the door to its closed position in response to removing the connector from the adapter frame. An auxiliary spring may be provided to facilitate biasing the door toward its closed position.

According to a further aspect of the invention, the adapter frame is provided with at least one mounting peg depending from at least one of the wall portions for insertion into an appropriate mounting hole in a printed circuit board. The mounting peg has at least two levels of engaging surfaces for engaging at least two printed circuit boards of different thicknesses.

The invention contemplates that the entire metal adapter frame, including the receptacle portion, the wall portions, the stiffening ribs, the gasket, the cam ramps, the auxiliary spring and the mounting pegs be a one-piece sheet metal structure.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
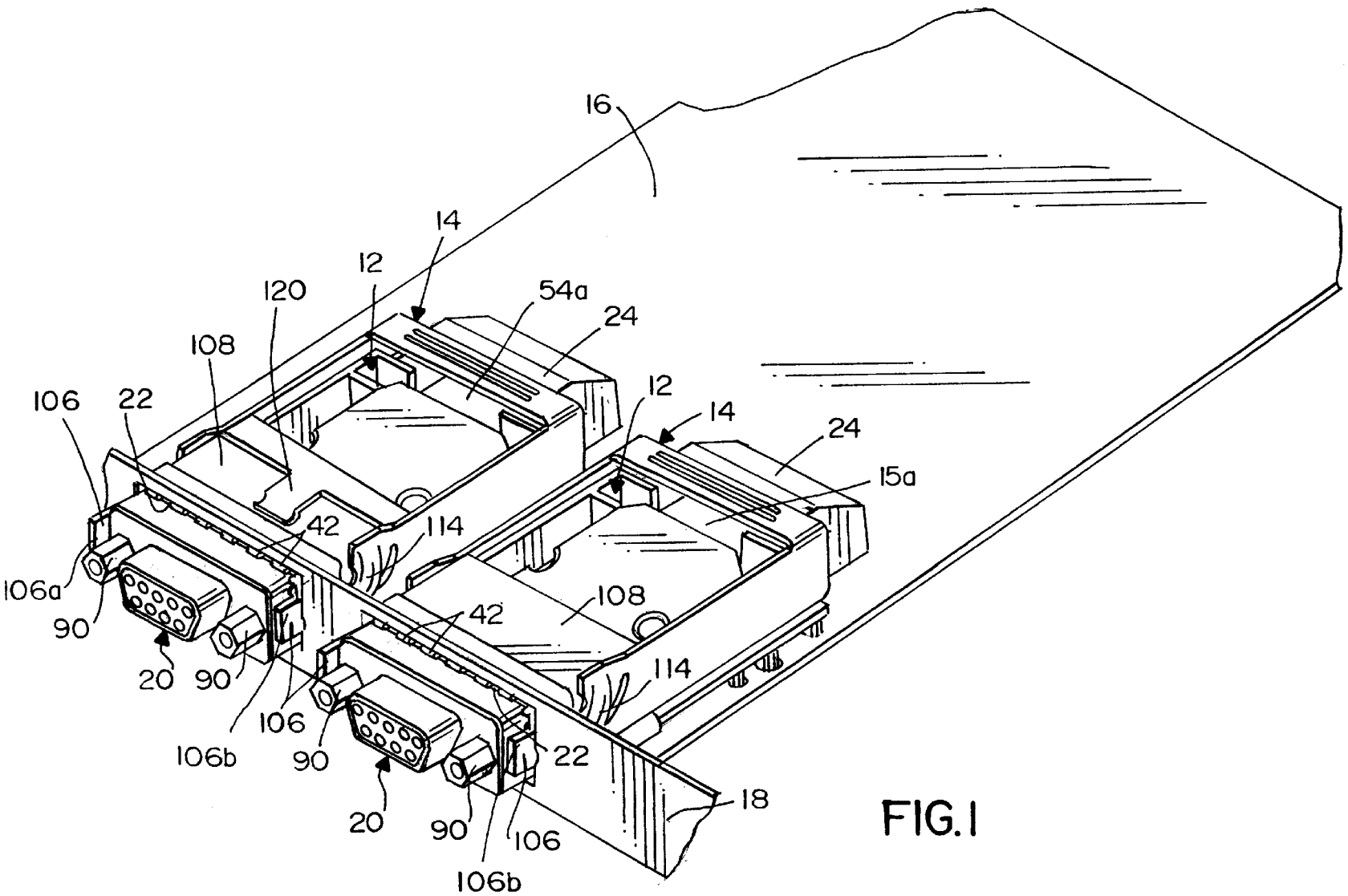
FIG. 1 is a perspective view of a pair of high speed electrical converter modules according to the invention mounted within a pair of adapter frames according to the invention, with those assemblies being mounted on a printed circuit board and through a bracket.

Referring to the drawings in greater detail, and first to FIG. 1, the invention is embodied in a high speed electronic receiver-transmitter system which includes one or more high speed electrical converter modules, generally designated 12. Each converter module is mounted within a one-piece stamped and formed sheet metal adapter frame, generally designated 14. Each frame, in turn, is mounted on a printed circuit board 16. A panel or mounting bracket 18 is appropriately fixed to printed circuit board 16. Front mating faces, generally designated 20, of converter modules 12 project through apertures 22 in bracket 18. With the system described above in relation to FIG. 1, printed circuit board 16 could be the mother board of a switching telecommunications system at a given location, such as in a large building. Of course, there would be more converter modules in such a large installation. Complementary mating connectors would be plugged into the mating faces 20 of converter modules 12. The mating connectors would carry signals at high speeds, such as in the gigabit range. Converter modules 12 receive these high speed signals and transfer and maintain the signals at high speed for transmission to card edge connectors, generally designated 24, mounted on the mother board. The card edge connectors could be right-angled connectors or vertical connectors. Such card edge connectors are well known in the art and will not be described in detail herein.

Figure 2:
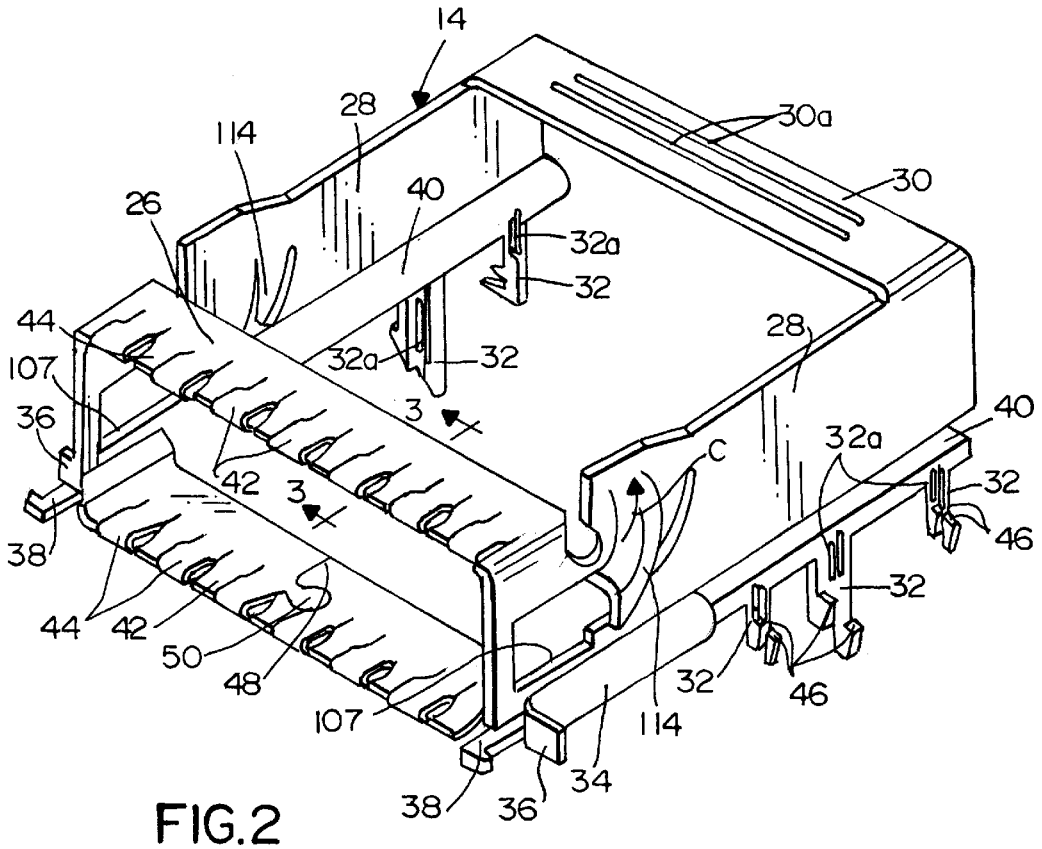
FIG. 2 is a perspective view of the one-piece metal adapter frame.
Figure 3:
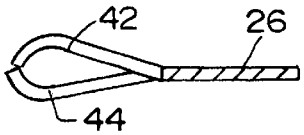
FIG. 3 is a vertical section taken generally along line 3—3 of FIG. 2.
Figure 4:
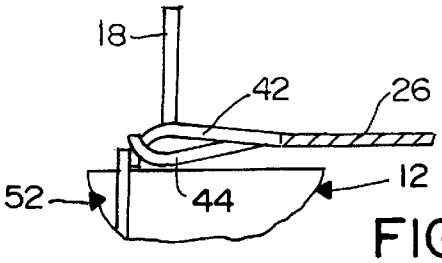
FIG. 4 is a view similar to that of FIG. 3, with the gasket fingers compressed by engagement between the panel and the converter module.

Referring to FIGS. 2–4 in conjunction with FIG. 1, each adapter frame 14 is a one-piece structure unitarily stamped and formed of sheet metal material. The frame includes a front box-like receptacle portion 26 which is generally rectangular in configuration. A pair of integral supporting side walls 28 project rearwardly from the receptacle portion. The top edges of the side walls are joined by a bridge portion 30 at the rear thereof. The bridge portion may be stamped with stiffening gussets 30*a*. A plurality of mounting pegs 32 depend from side walls 28 for insertion into appropriate mounting holes in printed circuit board 16 (FIG. 1). The mounting pegs are stamped with stiffening gussets 32*a*.

One of the features of adapter frame 14 (FIG. 2) is the provision of a multi-function stiffening rib 34 projecting outwardly from each opposite side of the frame near the front thereof. The stiffening rib is semi-cylindrical in cross-section and terminates in a forward stop flange 36 which abuts against the rear of bracket 18 (FIG. 1) to define a preferred position of the adapter frame relative to the bracket. Therefore, rib 34 performs a dual function of stiffening the frame on the outside of receptacle portion 26 as well as providing a stop against the rear surface of the bracket. One or more latch hooks 38 may be provided for snapping into engagement with the front surface of bracket 18.

Another feature of adapter frame 14 is the provision of a second stiffening rib 40 projecting inwardly from each side wall 28. The second stiffening ribs extend rearwardly of front stiffening ribs 34. Like the front stiffening ribs, rear stiffening ribs 40 are semi-cylindrical in cross-section. The second stiffening ribs perform a dual function of rigidifying side walls 28 and also providing guide rails for the insertion of one of the converter modules 12 (FIG. 1) thereinto.

Referring to FIGS. 3 and 4 in conjunction with FIG. 2, a further feature of adapter frame 14 is the provision of integral, flexible gasket means circumferentially about at least the top and bottom of receptacle portion 26. Specifically, the gasket means is provided by alternating flexible fingers 42 and 44 along the top and bottom front edges of receptacle portion 26. Alternating fingers 42 are deformed outwardly in a bowed configuration, and alternating fingers 44 are deformed inwardly in a bowed configuration. Outwardly bowed fingers 42 engage the inner edges of the respective aperture 22 in bracket 18, and inwardly bowed fingers 44 engage converter module 12, as seen in FIG. 4. As seen in FIG. 4, the distal ends of fingers 42 abut a flange 64 of a connector 52 (described hereinafter) to provide a stop for insertion of module 12. The fingers are closely spaced to prevent RF emissions therebetween.

Still another feature of adapter frame 14 is the provision of means on mounting pegs 32 for accommodating printed circuit boards of different thicknesses. Specifically, each mounting peg 32 is provided with engaging surfaces 46 which are at different levels for engaging at least two printed circuit boards of different thickness.

Finally, and still referring to FIG. 2, with adapter frame 14 being a one-piece structure stamped and formed from sheet metal material, the formed frame is joined at a seam 48 located at the bottom of receptacle portion 26. A key-hole shaped lock 50 is provided at the seam to prevent separation of the frame along the seam. The seam alternatively can be staked, welded, soldered or otherwise prevented from separation.

Figure 5:
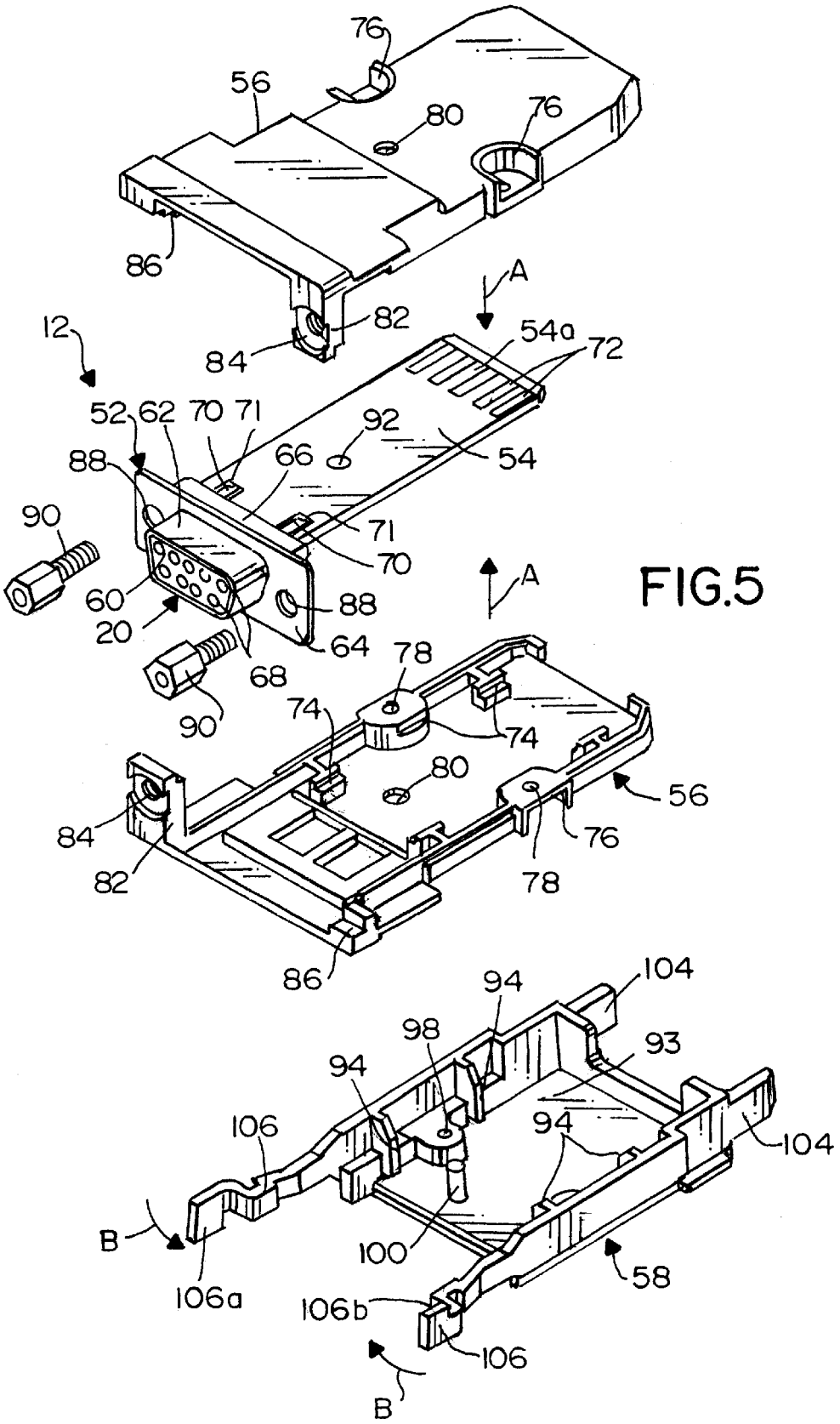
FIG. 5 is an exploded perspective view of the high speed electrical converter module.

FIG. 5 is an exploded perspective view of one of the high speed electrical converter modules 12 to show the various components thereof. Specifically, the converter module includes a forward plug-in electrical connector, generally designated 52, terminated to a printed circuit card 54 which projects rearwardly of the connector. A pair of identical or hermaphroditic backshell halves, generally designated 56, sandwich printed circuit card 54 therebetween, except for a rear edge 54*a* of the card which projects rearwardly of the converter module as seen in FIG. 1. The subassembly of connector 52, circuit card 54 and backshell halves 56 are mounted in a frame, generally designated 58.

Figure 10:
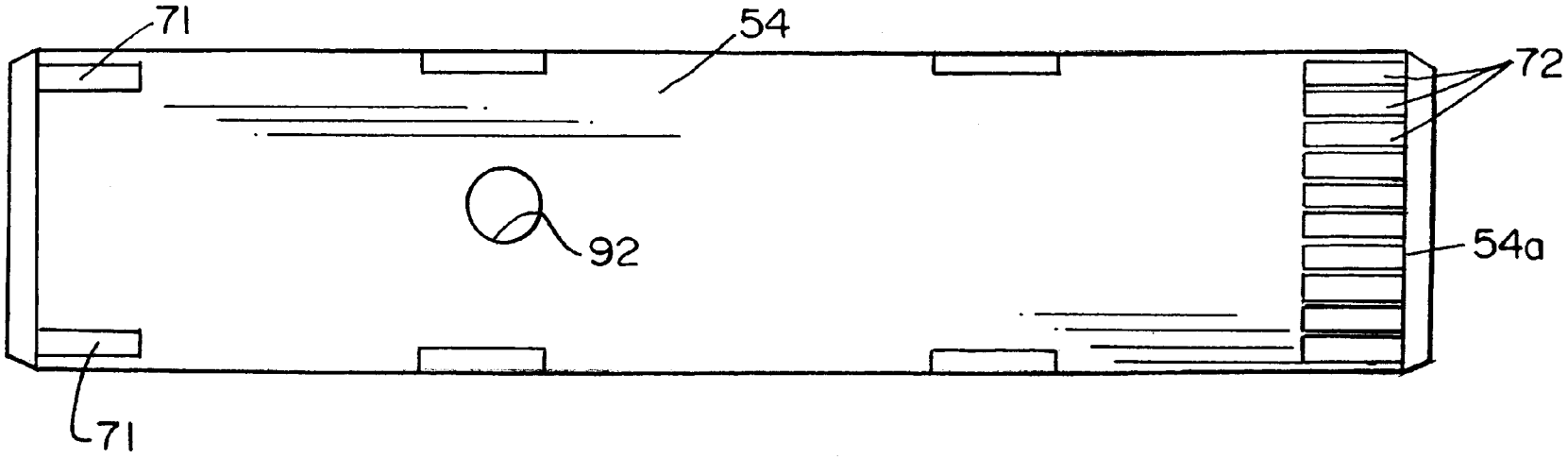
FIG. 10 is a plan view of the printed circuit card of the converter module.

More particularly, forward electrical connector 52 of converter module 12 includes a dielectric housing 60 surrounded by a stamped and formed metal shell which includes a shroud portion 62, a flange portion 64 and a rear portion 66. Shroud portion 62 and the interior portion of the dielectric housing are D-shaped to define front mating face 20 of the connector. The dielectric housing includes a plurality of terminal-receiving passages 68 which receive a plurality of terminals. The terminals include tail portions projecting from the rear of the connector for appropriate connection to circuit traces on printed circuit card 54, as by soldering for example. Two of the terminal tail portions are shown at 70 in FIG. 5 connected to circuit pads 71 on the circuit card. Rear edge 54*a* of circuit card 54 includes appropriate circuit pads 72 for direct engagement with contacts within the respective right-angled card edge connector 24 (FIG. 1). Various circuitry is provided on printed circuit card 24 for maintaining and transferring high speed signals from a mating connector plugged into connector 52 to the card edge connector 24. FIG. 10 simply shows a plan view of printed circuit card 54 isolated from connector 52. By eliminating a connector at the rear edge of card 54, a cleaner signal is provided with higher reliability since there are no discontinuities through any connector solder joints.

Figure 6:
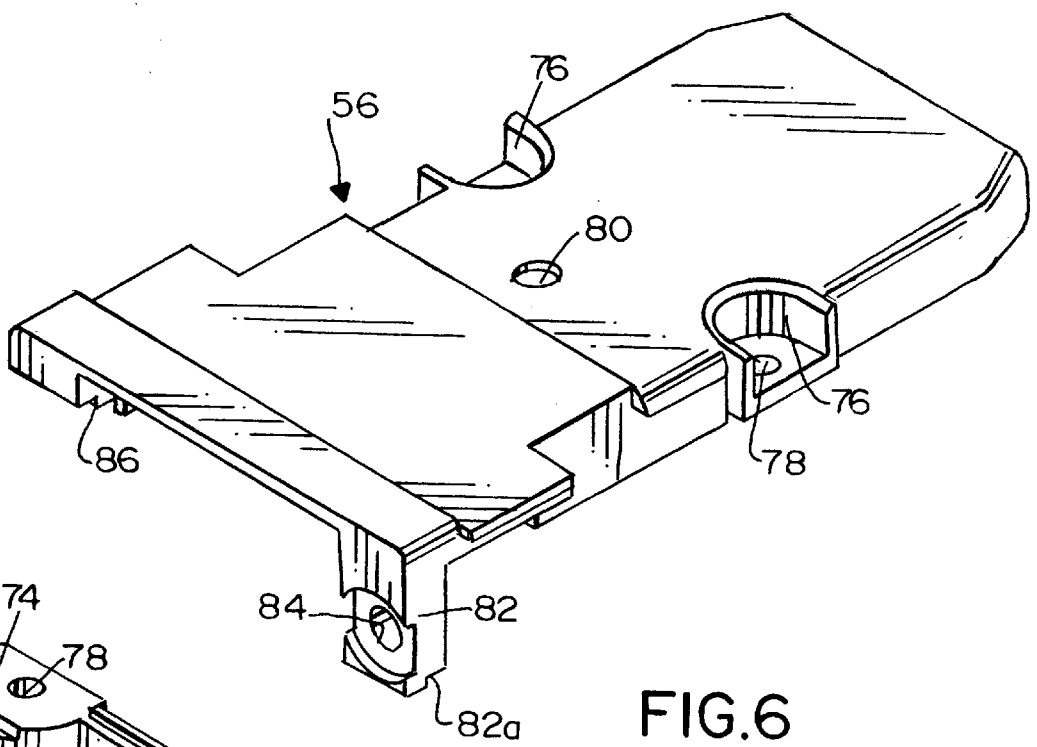
FIGS. 6 and 7 are perspective views, at different angles, of the identical backshell halves of the converter module.
Figure 7:
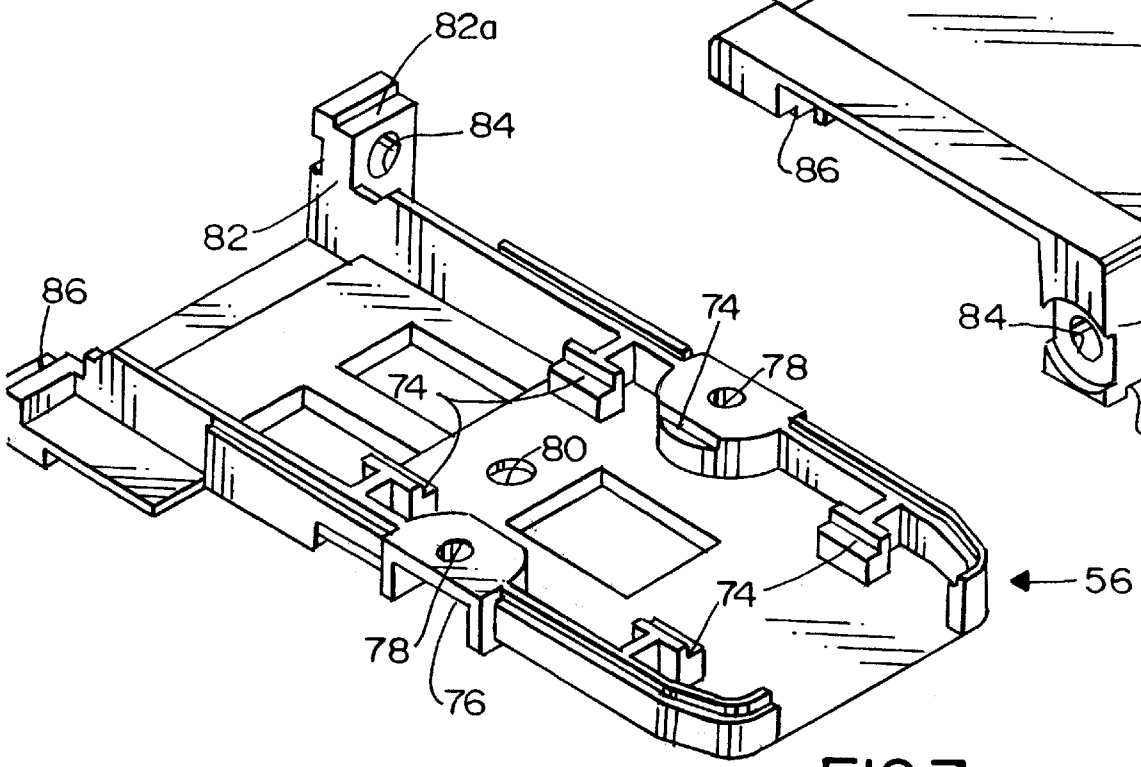

Referring to FIGS. 6 and 7 in conjunction with FIG. 5, each backshell half 56 is similar but, in the preferred embodiment, each backshell half is identical or hermaphroditic in construction. The backshell halves are conductive, as of cast metal material. Specifically, each backshell half includes a series of stepped support ledges 74 along opposite sides of the inside thereof for supporting printed circuit card 54. A recessed area 76 on each side of the backshell half includes a through hole 78 for receiving an appropriate fastener, as described hereinafter. Each backshell half includes a locating hole 80 for purposes described hereinafter. Each backshell half includes a mounting flange 82 at one corner thereof, the flange having a through hole 84. The flange has a stepped distal end, as at 82*a*, for engaging a complementarily stepped edge 86 of the opposite backshell half when the two halves are assembled to sandwich printed circuit card 54 therebetween.

When backshell halves 56 are assembled to connector 52 and circuit card 54 in the direction of arrows "A", holes 84 in flanges 82 of the backshell halves become aligned with a pair of holes 88 in flange portion 64 of the connector shell. Holes 84 are internally threaded, and a pair of bolt-like fasteners 90 (FIG. 5) are used to secure the assembled backshell halves to the rear of flange portion 64 of connector 52. Alternatively, holes 84 simply can be drilled and the backshell halves can be riveted to the flange portion of the connector. Therefore, the backshell halves are conductively commoned to the metal shell of connector 52. The backshell halves can optionally isolate or electrically connect to the printed circuit board 16. In addition, when the backshell halves sandwich circuit card 54 therebetween, locating holes 80 through the backshell halves become aligned with a locating hole 92 in circuit card 54. When the backshell halves are assembled to connector 52, only the rear edge of circuit card 54 is exposed. Otherwise the card is fully shielded by the backshell halves.

Figure 8:
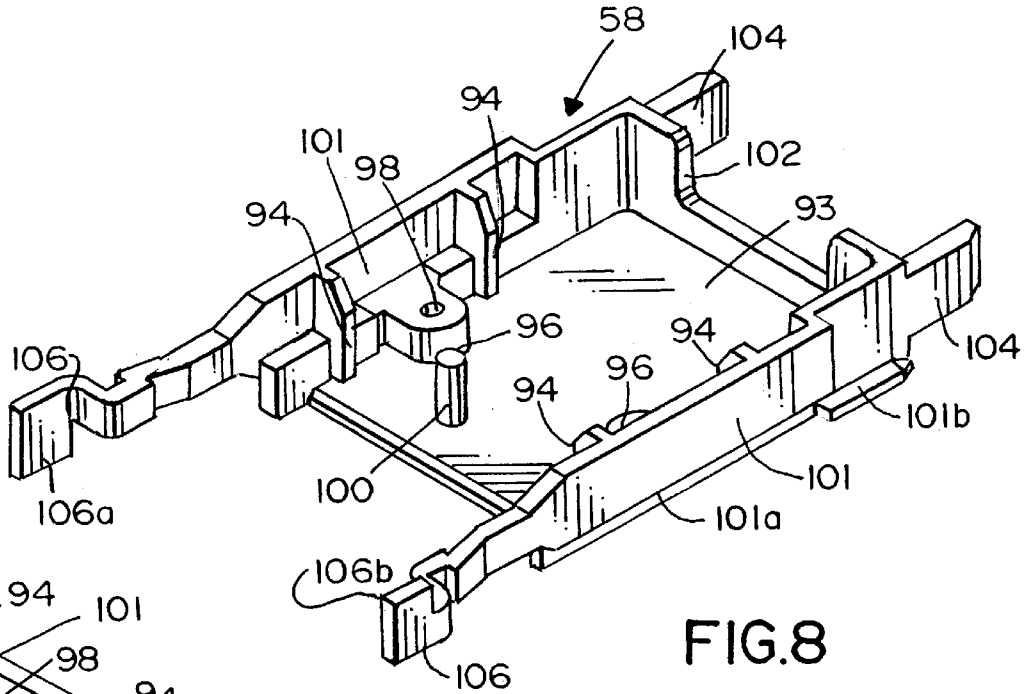
FIGS. 8 and 9 are perspective views, at different angles, of the frame for the converter module.
Figure 9:
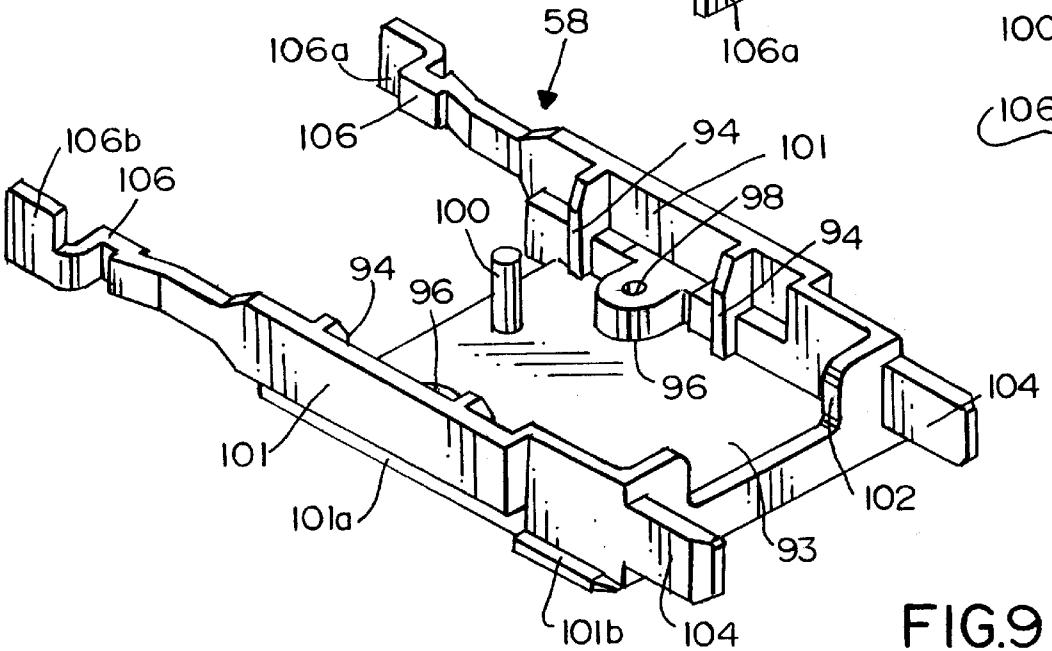

Referring to FIGS. 8 and 9 in conjunction with FIG. 4, frame 58 is a one-piece structure unitarily molded of dielectric material such as plastic or the like. The frame also can be fabricated of a conductive static dissipative material such as plastic impregnated with carbon particles or fibers. The frame forms a holding receptacle for the assembled backshell halves, with the backshell halves resting on a bottom plate or wall 93 of the frame between side gussets 94 of the frame. A pair of bosses 96 of the frame seat within recessed areas 76 of the bottommost backshell half. Bosses 96 have internally threaded holes 98. Therefore, appropriate threaded fasteners are inserted through holes 78 in the backshell halves and are threaded into holes 98 to secure the assembly of connector 52, circuit card 54 and backshell halves 56 within frame 58. Alternatively, holes 98 simply can be drilled and rivets can be used instead of threaded fasteners. When so assembled, a locating pin 100 which projects upwardly from bottom wall 93 of the frame, projects upwardly through locating holes 80 in the backshell halves and locating hole 92 in the circuit card. The frame has opposite side walls 101 with offset bottoms 101*a* which ride on the tops of guide rails 40 of adapter frame 14. The side walls also have outside flanges 101*b* which slide under the guide rails and prevent the module from being inserted into the frame in a cocked position. The rear edge 54*a* of the circuit card projects rearwardly of the frame through a notch 102 for insertion into one of the card edge connectors 24 (FIG. 1). A pair of rear flanges 104 of the frame provide guides which engage and straddle the card edge connector. If the frame is conductive, it can provide electrostatic discharge grounding to special contacts on the card edge connector. Finally, the frame has a pair of forwardly projecting, flexible latch arms 106 which snap into engagement with the side edges of apertures 22 (FIG. 1) in the panel or bracket 18. With the latch arms fabricated of plastic material, they will not wear the side edges of the apertures. The latch arms project through apertures 107 (FIG. 2) in side walls 28 of frame 14.

The left-hand latch arm has a downwardly directed projection 106*a,* and the right-hand latch arm has an upwardly directed projection 106*b*. This allows an operator to squeeze the latches toward each other to remove a module when a plurality of modules are located very close to each other.

The entire high speed electrical converter module 12 is inserted into one of the metal adapter frames 14 through a door 108 (FIG. 11) of the adapter frame. Latch arms 106 of frame 58 of the converter module hold the module within the adapter frame. The converter module is removed by pinching inwardly on flexible latch arms 106 in the direction of arrows "B" (FIG. 5), and the converter module simply is pulled out of the adapter frame. Door 108 automatically closes when the converter module is removed.

Figure 11:
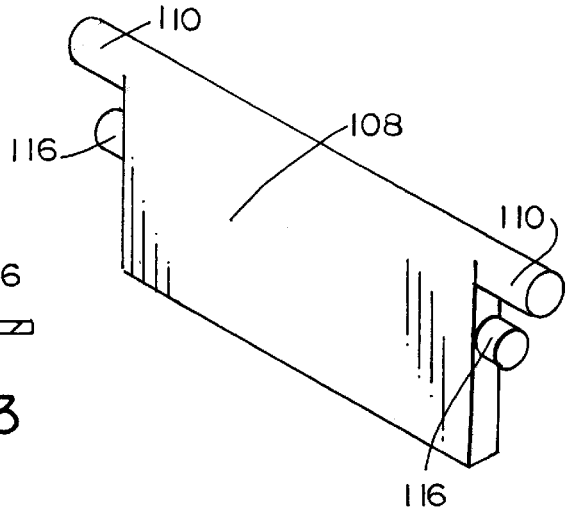
FIG. 11 is a perspective view of the door which closes the receptacle of the adapter frame.

FIG. 11 shows a feature of the invention whereby receptacle 26 of adapter frame 14 can be closed when converter module 12 is removed from the adapter frame. More particularly, a generally rectangular door 108 is sized for closing receptacle portion 26 of adapter frame 14. The door is pivotally mounted between side walls 28 (FIG. 2) of the adapter frame by means of a pair of pivot stub shafts 110 which project outwardly from opposite sides of the door for snap-engagement within pivot apertures 112 in side walls 28. Each side wall may be formed with the cam ramp 114 which is engageable by a cam follower projection 116 at opposite sides of the door. When the door is opened, cam follower projections 116 ride up cam ramps 114 in the direction of arrow "C" to store energy within the somewhat flexible side walls. Of course, the side walls are stiffened by stiffening ribs 34 and 40. When converter module 12 is withdrawn from the adapter frame, the stored energy causes door 108 to close by the biasing effect of the angled cam ramps 114 on cam follower projections 116. Preferably, the door is of metal material and reduces electromagnetic leakage through the door. With adapter frame 14 also fabricated of metal, electrostatic charges do not build up on the door but are dissipated to the frame.

The left-hand adapter frame 14 in FIG. 1 shows an auxiliary, integral leaf spring 120 which can be used for engaging door 108 to facilitate biasing the door toward its closed position automatically when the converter module is withdrawn from the adapter frame.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A stamped and formed metal adapter frame for mounting an electrical connector in an aperture in a panel, comprising:

a receptacle portion positionable in the aperture in the panel for receiving the electrical connector;

supporting wall portions projecting from the receptacle portion; and at least one stiffening rib formed in at least one of the wall portions, the stiffening rib including a stop for abutting the panel to define a preferred position of the adapter frame relative to the panel and wherein said stiffening rib is semi-cylindrical in cross-section.

2. The stamped and formed metal adapter frame of claim 1 wherein the frame, including the receptacle portion, the wall portions and the stiffening rib, is a one-piece sheet metal structure.

3. The stamped and formed metal adapter frame of claim 1, including a second stiffening rib formed in at least one of the wall portions and projecting inwardly therefrom to define a guide rail for the electrical connector inserted through said receptacle portion.

4. The stamped and formed metal adapter frame of claim 3 wherein said second stiffening rib is semi-cylindrical in cross-section.

5. The stamped and formed metal adapter frame of claim 3 wherein said stiffening rib with said stop defines a first stiffening rib forwardly of said second stiffening rib.

6. The stamped and formed metal adapter frame of claim 5 wherein said supporting wall portions include a pair of side walls projecting rearwardly from opposite sides of the receptacle portion, with one of said first and said second stiffening ribs on each side wall to define a pair of stops on opposite sides of the frame and a pair of guide rails for opposite sides of the electrical connector.

7. The stamped and formed metal adapter frame of claim 1 wherein said receptacle portion includes integral, flexible gasket means for engaging the interior of the aperture in the panel and the exterior of the electrical connector.

8. The stamped and formed metal adapter frame of claim 7 wherein said gasket means comprise alternatingly inwardly and outwardly deformed flexible fingers.

9. A stamped and formed metal adapter frame for mounting an electrical connector in an aperture in a panel, comprising:

a receptacle portion positionable in the aperture in the panel for receiving the electrical connector;

supporting wall portions projecting from the receptacle portion; and at least one stiffening rib formed in at least one of the wall portions and projecting inwardly therefrom to define a guide rail for the electrical connector inserted through said receptacle portion and wherein said stiffening rib is semi-cylindrical in cross-section.

10. The stamped and formed metal adapter frame of claim 9 wherein the frame, including the receptacle portion, the wall portions and the stiffening rib, is a one-piece sheet metal structure.

11. The stamped and formed metal adapter frame of claim 9 wherein said supporting wall portions include a pair of side walls projecting rearwardly from opposite sides of the receptacle portion, with one of said stiffening ribs on each side wall to define a pair of guide rails for opposite sides of the electrical connector.

12. The stamped and formed metal adapter frame of claim 9 wherein said receptacle portion includes integral, flexible gasket means for engaging the interior of the aperture in the panel and the exterior of the electrical connector.

13. The stamped and formed metal adapter frame of claim 12 wherein said gasket means comprise alternatingly inwardly and outwardly deformed flexible fingers.

14. An adapter frame for mounting an electrical connector, comprising:

a receptacle for receiving the electrical connector;

side walls at opposite sides of the receptacle;

a door pivotally mounted between the side walls for pivotal movement between a closed position closing the receptacle and an open position when the connector is inserted into the receptacle; and complementary interengaging cam means between the door and at least one of the side walls for automatically biasing the door to its closed position in response to removing the connector from the receptacle.

15. The adapter frame of claim 14 wherein said complementary interengaging cam means comprise a cam ramp on the at least one side wall engageable by a cam follower on the door.

16. The adapter frame of claim 15, including one of said cam ramps on each side wall and a pair of cam followers at opposite sides of the door.

17. The adapter frame of claim 14, including auxiliary spring means on the frame engageable with the door to facilitate biasing the door toward its closed position.

18. The adapter frame of claim 17 wherein the frame is stamped and formed of sheet metal material, and said auxiliary spring means comprises at least one integral leaf spring.

19. An adapter frame for mounting an electrical connector, comprising:

a receptacle for receiving the electrical connector;

side walls at opposite sides of the receptacle;

a door pivotally mounted between the side walls for pivotal movement between a closed position closing the receptacle and an open position when the connector is inserted into the receptacle; and a leaf spring projecting from the receptacle and engageable with the door for biasing the door toward its closed position.

20. The adapter frame of claim 19 wherein said frame, including said receptacle, is stamped and formed of sheet metal material and said leaf spring is an integral part thereof.

21. A one-piece stamped and formed metal adapter frame for mounting an electrical connector in an aperture in a panel, comprising:

a receptacle portion positionable in the aperture in the panel for receiving the electrical connector;

supporting wall portions projecting from the receptacle portion;

at least one first stiffening rib formed in at least one of the wall portions, the stiffening rib including a stop for abutting the panel to define a preferred position of the adapter frame relative to the panel wherein said first stiffening rib is semi-cylindrical in cross-section;

a second stiffening rib formed in at least one of the wall portions and projecting inwardly therefrom to define a guide rail for the electrical connector inserted through said receptacle portion;

an integral, flexible gasket means about a portion of the receptacle for engaging the interior of the aperture in the panel and the exterior of the electrical connector; and at least one mounting peg depending from at least one of the wall portions for insertion into an appropriate mounting hole in a printed circuit board.

22. The one-piece stamped and formed metal adapter frame of claim 21 wherein said second stiffening rib is semi-cylindrical in cross-section.

23. The one-piece stamped and formed metal adapter frame of claim 21 wherein said gasket means comprise alternatingly inwardly and outwardly deformed flexible fingers.

24. The one-piece stamped and formed metal adapter frame of claim 21 wherein said mounting peg has at least two levels of engaging surfaces for engaging at least two printed circuit boards of different thicknesses.

25. The one-piece stamped and formed metal adapter frame of claim 21 wherein said first stiffening rib is forwardly of said second stiffening rib.

26. The one-piece stamped and formed metal adapter frame of claim 25 wherein said supporting wall portions include a pair of side walls projecting rearwardly from opposite sides of the receptacle portion, with one of said first and said second stiffening ribs on each side wall to define a pair of stops on opposite sides of the frame and a pair of guide rails for opposite sides of the electrical connector.

* * * * *